US006162547A

United States Patent [19]

van Ooji et al.

[11] Patent Number: 6,162,547

[45] Date of Patent: Dec. 19, 2000

[54] CORROSION PREVENTION OF METALS USING BIS-FUNCTIONAL POLYSULFUR SILANES

[75] Inventors: Wim J. van Ooji, Fairfield; Vijay Subramanian, Cincinnati, both of Ohio

[73] Assignee: The University of Cinncinnati, Cincinnati, Ohio

[21] Appl. No.: 09/104,260

[22] Filed: Jun. 24, 1998

[51] Int. Cl.[7] ..... B32B 15/04; B32B 15/08; L08G 77/28; L07F 7/02

[52] U.S. Cl. ..... 428/447; 427/387; 428/450; 528/30; 528/33; 528/35; 556/427

[58] Field of Search ..... 427/387; 528/30, 528/35, 33; 524/767; 556/427; 428/447, 450

[56] References Cited

U.S. PATENT DOCUMENTS

| | | | |
|---|---|---|---|
| 4,000,347 | 12/1976 | Ranney et al. | 428/419 |
| 4,015,044 | 3/1977 | Ranney et al. . | |
| 4,059,473 | 11/1977 | Okami . | |
| 4,152,347 | 5/1979 | Pletka et al. . | |
| 4,222,930 | 9/1980 | Pletka et al. . | |
| 4,243,718 | 1/1981 | Murai et al. . | |
| 4,315,970 | 2/1982 | McGee . | |
| 4,401,500 | 8/1983 | Hamada et al. . | |
| 4,409,266 | 10/1983 | Wieczorrek et al. . | |
| 4,457,970 | 7/1984 | Das et al. . | |
| 4,534,815 | 8/1985 | Hamada et al. . | |
| 4,681,636 | 7/1987 | Saito et al. . | |
| 4,689,085 | 8/1987 | Plueddemann . | |
| 4,863,794 | 9/1989 | Fujii et al. . | |
| 5,108,793 | 4/1992 | van Ooji et al. . | |
| 5,200,275 | 4/1993 | van Ooji et al. . | |
| 5,217,751 | 6/1993 | King et al. . | |
| 5,221,371 | 6/1993 | Miller . | |
| 5,292,549 | 3/1994 | van Ooji et al. . | |
| 5,322,713 | 6/1994 | van Ooji et al. . | |
| 5,326,594 | 7/1994 | Sabata et al. . | |
| 5,389,405 | 2/1995 | Purnell et al. . | |
| 5,393,353 | 2/1995 | Bishop . | |
| 5,405,985 | 4/1995 | Parker et al. . | |
| 5,433,976 | 7/1995 | van Ooji et al. . | |
| 5,455,080 | 10/1995 | van Ooji et al. . | |
| 5,466,848 | 11/1995 | Childress . | |
| 5,468,893 | 11/1995 | Parker et al. . | |
| 5,478,655 | 12/1995 | Sabata et al. . | |
| 5,498,481 | 3/1996 | van Ooji . | |
| 5,539,031 | 7/1996 | van Ooji . | |
| 5,639,555 | 6/1997 | Bishop . | |
| 5,700,523 | 12/1997 | Petrole et al. . | |
| 5,750,197 | 5/1998 | van Ooji et al. . | |
| 5,789,080 | 8/1998 | Grimberg et al. | 428/379 |

FOREIGN PATENT DOCUMENTS

| | | |
|---|---|---|
| 0435781 | 11/1990 | France . |
| 58-52036 | 11/1983 | Japan . |
| 63-97266 | 4/1988 | Japan . |

OTHER PUBLICATIONS

Plueddemann, Edwin P., *Silane primers for epoxy adhesives,* pp. 179–188, J. Adhesions Sci. Technol. vol. 2, No. 3, 1988.

Plueddemann, Edwin P., *Reminiscing on silane coupling agents,* pp. 261–277, J. Adhesion Sci. Technol. vol. 5, No. 4, 1991.

P. Walker, *Organosilanes as adhesion promoters,* pp. 279–305, J. Adhesion Sci. Technol. vol. 5, No. 4, 1991.

A. Sabata, et al., *Trends toward a better understanding of the interface in painted metals,* pp. 181–193, Trends in Corrosion Research, 1 (1993).

A. Sabata, et al., *The interphase in painted metals pretreated by functional silanes,* pp. 1153–1170, J. Adhesion Sci. Technol. vol. 7, No. 11, 1993.

W.J. Van Ooji, et al. *Characterization of Films of Organofunctional silanes by ToF–SIMS,* pp. 475–484, Surface and Interface Analysis, vol. 20, 1993.

Wim. J. Van Ooji, et al. *Modifications of the Interface Between Paints and Stainless Steels by Means of an Interphase of Crosslinked Organofunctional Silanes,* pp. 155–160, Materials Research Society Symposium Proceedings, vol. 304, 1993.

A Sabata, et al. *TOFSIMS Studies of Cleaning Procedures and Silane Surface Treatments of Steels,* pp. 119–125, Journal of Testing and Evaluation, 1995.

2nd Annual Advanced Techniques for Replacing Chromium: An Information Exchange, prepared by David S. Viszlay, Submitted by Concurrent Technologies Corporation, NDCEE Nov. 1995.

W. J. Van Ooji, et al., *On the Use, Characterization and Performance of Silane Coupling Agents Between Organic Coatings and Metallic or Ceramic Substrates,* pp. 305–321, 1996 American Institute of Physics.

Hornstrom, et al., *Paint adhesion and corrosion performance of chromium–free pretreatments of 55*

Al–Zn–coated steel, pp. 883–904, J. Adhesion Sci. Technol. vol. 10, No. 9, 1996.

(List continued on next page.)

*Primary Examiner*—Robert Dawson
*Assistant Examiner*—Jeffrey B. Robertson
*Attorney, Agent, or Firm*—Dinsmore & Shohl LLP

[57] ABSTRACT

A method of preventing corrosion of metals using bis-functional polysulfur silanes. The method includes providing a metal surface, and applying a treatment solution onto the metal surface. The treatment solution includes at least one hydrolyzed bis-functional polysulfur silane of the formula:

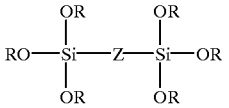

wherein each R is an alkyl or an acetyl group, and Z is either $—S_x$ or $—Q—S_x—Q—$, wherein each Q is an aliphatic or aromatic group, and x is an integer of from 2 to 9. A treatment solution and metal surface having improved corrosion resistance are also provided.

29 Claims, No Drawings

OTHER PUBLICATIONS

B. C. Zhang, et al., *Characterization of Silane Films Deposited on Iron Surfaces,* Submitted to Langmuir, May 3, 1996.

Wei Yuan, et al., *Charaterization of Organofunctional Silane Films on Zinc Substrates,* Submitted to Journal of Colloid and Interface Science, Aug. 30, 1996.

S. E. Hornstrom, et al., *Charaterization of Thin Films of Organofunctional and Non–Functional Silanes on 55AI–43.4Zn–1.6Si Alloy Coated Steel,* pp. 987–990, ECASIA 97, 1997.

W. J. Van Ooij, et al., *Pretreatment of Metals for Painting by Organofunctional Silanes,* Extended Abstract of Paper Presented at 1997 International Symposium on Advances in Corrosion Protection by Organic Coatings, Noda, Japan, Oct. 1997.

W. J. Van Ooij, et al. *Silane Coupling Agent Treatments of Metals for Corrosion Protection,* Presented at the Fourth International Forum and Business Development Conference on Surface Modification, Couplants and Adhesion Promoters, Adhesion Coupling Agent Technology 97, Boston, MA 1997.

W. J. Van Ooji, et al., *Rubber to Metal Bonding,* Presented at the International Conference on Rubbers, Calcutta, India, Nov. 1997.

Wu, Guan–Li, et al., *Alcoholysis of chlorosilanes and the synthesis of silance coupling agents,* Inst. Chem., Adad. Sin., Peking, People Rep. China, Hua Hsueh Hsueh Pao (1980), 38(5), 484–8.

CORROSION PREVENTION OF METALS USING BIS-FUNCTIONAL POLYSULFUR SILANES

BACKGROUND OF THE INVENTION

1. Field of the Invention

The present invention relates to a method of preventing corrosion of metal surfaces. More particularly, the present invention provides a method of preventing corrosion of a metal surface which comprises applying a solution containing one or more bis-functional polysulfur silanes to the metal surface. The method is particularly useful for treating surfaces of zinc, copper, aluminum, and alloys of the foregoing metals (such as brass and bronze).

2. Description of Related Art

Most metals are susceptible to varying degrees and types of corrosion which will significantly affect the quality of such metals, as well as that of the products produced therefrom. Although many forms of corrosion can sometimes be prevented, such steps are costly and may further diminish the utility of the final product. In addition, when polymer coatings such as paints, adhesives, or rubbers are applied to the metal, corrosion of the base metal material may cause a loss of adhesion between the polymer coating and the base metal.

Prior art techniques for improving corrosion resistance of metals, particularly metal sheet, include passivating the surface by means of a heavy chromate treatment. Such treatment methods are undesirable, however, because the chromate ion is highly toxic, carcinogenic and environmentally undesirable. It is also known to employ a phosphate conversion coating in conjunction with a chromate rinse in order to improve paint adherence and provide corrosion protection. It is believed that the chromate rinse covers the pores in the phosphate coating, thereby improving the corrosion resistance and adhesion performance. Once again, however, it is highly desirable to eliminate the use of chromate altogether. Unfortunately, the phosphate conversion coating is generally not effective without the chromate rinse.

Recently, various techniques for eliminating the use of chromate have been proposed. These include coating the metal with an inorganic silicate followed by treating the silicate coating with an organofunctional silane (U.S. Pat. No. 5,108,793). U.S. Pat. No. 5,292,549 teaches the rinsing of metal sheet with a solution containing an organofunctional silane and a crosslinking agent in order to provide temporary corrosion protection. The crosslinking agent crosslinks the organofunctional silane to form a denser siloxane film. One significant drawback of the methods of this patent, however, is that the organofunctional silane will not bond well to the metal surface, and thus the coating of U.S. Pat. No. 5,292,549 may be easily rinsed off. Various other techniques for preventing the corrosion of metal sheets have also been proposed. Many of these proposed techniques, however, are ineffective, or require time-consuming, energy-inefficient, multi-step processes.

Further complicating the task of preventing corrosion of metals is the fact that corrosion can occur by a number of different mechanisms, depending in large part upon the particular metal in question. Brass, for example, is very sensitive to corrosion in aqueous environments (particularly uniform corrosion), dezincification (especially in acid-chloride containing solutions), and stress corrosion cracking (particularly in the presence of ammonia and amines). Copper, and copper alloys (including brass) will tarnish readily in air and in sulfur-containing environments. Zinc, and zinc alloys, on the other hand, are particularly susceptible to the formation of "white rust" under humid conditions. Unfortunately, many of the prior art treatment methods for preventing corrosion are less effective on zinc, zinc alloys, copper, and copper alloys, especially brass and bronze, or are only effective for certain types of corrosion.

Thus, there is a need for a simple, low-cost technique for preventing corrosion of metal surfaces, particularly zinc, zinc alloys, aluminum, aluminum alloys, copper, and copper alloys (especially brass and bronze).

SUMMARY OF THE INVENTION

It is an object of the present invention to provide an improved method of preventing corrosion of metal surfaces.

It is another object of the present invention to provide a treatment solution for preventing corrosion of metal surfaces.

It is yet another object of the present invention to provide a method of preventing corrosion of metal surfaces, particularly zinc, copper, aluminum, and alloys of the foregoing metals.

The foregoing objects can be accomplished, in accordance with one aspect of the present invention, by providing a method of treating a metal surface to improve corrosion resistance, comprising the steps of:

(a) providing a metal surface; and (b) applying a treatment solution onto the metal surface, the treatment solution containing at least one bis-functional polysulfur silane which has been at least partially hydrolyzed, the silane comprising:

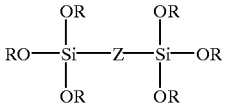

wherein (before hydrolysis) each R is an alkyl or an acetyl group, and Z is either —$S_x$ or —Q—$S_x$—Q—, wherein each Q is an aliphatic or aromatic group, and x is an integer of from 2 to 9 (preferably 4).

Each R may be individually chosen from the group consisting of: ethyl, methyl, propyl, iso-propyl, butyl, iso-butyl, sec-butyl, ter-butyl and acetyl. It will be understood, however, that hydrolysis of the silane results in the R groups (at least a portion of them, and preferably substantially all of them) being replaced by a hydrogen atom. Each Q may be individually chosen from the group consisting of: $C_1$–$C_6$ alkyl (linear or branched), $C_1$–$C_6$ alkenyl (linear or branched), $C_1$–$C_6$ alkyl substituted with one or more amino groups, $C_1$–$C_6$ alkenyl substituted with one or more amino groups, benzyl, and benzyl substituted with $C_1$–$C_6$ alkyl. One preferred group of silanes comprises bis-(triethoxysilylpropyl) sulfides having 2 to 9 sulfur atoms, particularly bis-(triethoxysilylpropyl) tetrasulfide.

The treatment method of the present invention is particular useful for metals chosen from the group consisting of: zinc, zinc alloys, copper, copper alloys, aluminum, and aluminum alloys. Examples of such metal surfaces are brass, bronze, and even hot-dipped galvanized steel.

The treatment solution also preferably includes water and a solvent, such as one or more alcohols (e.g., ethanol, methanol, propanol, and iso-propanol). The total concentration of the bis-functional polysulfur silanes in the treatment solution is between about 0.1% and about 25% by volume, more preferably between about 1% and about 5%. A preferred embodiment includes between about 3 and about 20 parts methanol (as the solvent) per each part water.

The present invention also provides a treatment solution for preventing corrosion of a metal substrate comprising at least one bis-functional polysulfur silane which has been at least partially hydrolyzed, the silane of the formula:

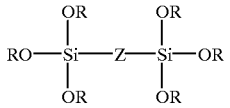

wherein each R (before hydrolysis) is an alkyl or an acetyl group, and Z is either $—S_x$ or $—Q—S_x—Q—$, wherein each Q is an aliphatic or aromatic group, and x is an integer of from 2 to 9.

A metal surface having improved corrosion resistance is also provided, and comprises:

(a) a metal surface; and (b) a silane coating bonded to the metal surface, the silane comprising at least one bis-functional polysulfur silane which has been at least partially hydrolyzed, the bis-functional polysulfur silane comprising:

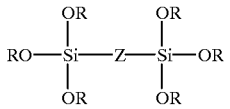

wherein each R is an alkyl or an acetyl group, and Z is either $—S_x$ or $—Q—S_x—Q—$, wherein each Q is an aliphatic or aromatic group, and x is an integer of from 2 to 9.

DETAILED DESCRIPTION OF THE PREFERRED EMBODIMENTS

Applicants have found that corrosion of metal surfaces, particularly surfaces of zinc, zinc alloys, aluminum, aluminum alloys, copper, and copper alloys, can be prevented by applying a treatment solution containing one or more bis-functional polysulfur silanes, wherein the silane(s) has been at least partially hydrolyzed. The bis-functional polysulfur silanes which may be used to prepare the treatment solution include:

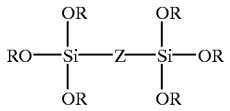

wherein each R is an alkyl or an acetyl group, and Z is either $—S_x$ or $—Q—S_x—Q—$. Each Q is an aliphatic (saturated or unsaturated) or aromatic group, and x is an integer of from 2 to 9 (preferably 4).

Each R within the sulfur-containing silane can be the same or different, and thus the silane may include both alkoxy and acetoxy moieties. As further outlined below, however, the silane(s) is hydrolyzed in the treatment solution, such that substantially all (or at least a portion) of the R groups are replaced with a hydrogen atom. In a preferred embodiment, each R may be individually chosen from the group consisting of: ethyl, methyl, propyl, iso-propyl, butyl, iso-butyl, sec-butyl, ter-butyl and acetyl. Similarly, Q within the bis-functional polysulfur silane can be the same or different. In a preferred embodiment, each Q is individually chosen from the group consisting of: $C_1$–$C_6$ alkyl (linear or branched), $C_1$–$C_6$ alkenyl (linear or branched), $C_1$–$C_6$ alkyl substituted with one or more amino groups, $C_1$–$C_6$ alkenyl substituted with one or more amino groups, benzyl, and benzyl substituted with $C_1$–$C_6$ alkyl.

Particularly preferred bis-functional polysulfur silanes include bis-(triethoxysilylpropyl) sulfides having 2 to 9 sulfur atoms. Such compounds have the following formula:

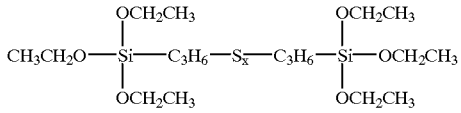

wherein x is an integer of from 2 to 9. One particularly preferred compound is bis-(triethoxysilylpropyl) tetrasulfide (also referred to as bis-(triethoxysilylpropyl) sulfane), wherein x is 4.

Applicants have found that the above-described bis-functional polysulfur silanes provide unexpectedly superior corrosion protection on surfaces of zinc, zinc alloys, aluminum, aluminum alloys, copper and copper alloys (particularly brass and bronze). In addition, these sulfur-containing silanes protect against multiple types of corrosion, including uniform corrosion, dezincification and stress corrosion cracking. The corrosion protection provided by the methods of the present is also superior to conventional chromate-based treatments, and avoids the chromium disposal problem.

The bis-functional polysulfur silanes employed in the present invention must be hydrolyzed so that the silane will bond to the metal surface. During hydrolysis, the alkyl or acetyl groups (i.e., the "R" moieties) are replaced with a hydrogen atom. While the silane should be at least partially hydrolyzed, the method of preparing the treatment solution of the present invention will generally result in substantially complete hydrolysis of the silane(s). As used herein, the term "partially hydrolyzed" simply means that only a portion of the R groups on the silane have been replaced with a hydrogen atom. Preferably, the bis-functional polysulfur silane(s) should be hydrolyzed to the extent that at least two (and, more preferably, substantially all) of the alkyl or acetyl groups on each molecule have been replaced with a hydrogen atom.

Hydrolysis of the bis-functional polysulfur silane may be accomplished merely be adding the silane to an alcohol/water mixture, thereby forming the treatment solution of the present invention. In general, mixing the silane with the alcohol/water mixture will result in full hydrolysis of the silane (substantially all of the R groups replaced with a hydrogen atom). The water actually hydrolyzes the silane, while the alcohol is necessary to ensure adequate silane solubility and solution stability. Alcohol also improves the wettability when the treatment solution is applied to the metal surface, and reduces the time necessary for drying. Of course other suitable solvents may be employed in place of alcohol. Presently preferred alcohols are methanol and ethanol, however other alcohols may similarly be employed (such as propanol or iso-propanol). It will also be understood that more than one alcohol may be used.

In order to prepare the treatment solution of the present invention, the alcohol and water should first be mixed with one another, preferably at a ratio of between about 3 and about 99 parts alcohol(s) per 1 part water (by volume), more preferably between about 3 and about 20 parts alcohol(s) per 1 part water. After thorough mixing, the silane(s) are added to the alcohol/water mixture and mixed thoroughly to ensure adequate hydrolysis. The treatment solution should be mixed for at least 30 minutes, and up to 24 hours in order to ensure complete hydrolysis (substantially all of the R groups replaced by a hydrogen atom), thereby forming the treatment solution of the present invention.

Stability of the treatment solution of the present invention may be enhanced (e.g., sulfur precipitation inhibited) by preparing and storing the treatment solution at a temperature less than room temperature (25 deg. C), more preferably between about 0 and about 20 deg. C. It should be noted, however, that Applicants have demonstrated good corrosion prevention results even if the treatment solution is mixed and stored at room temperature. In addition, exposure of the treatment solution to light should be limited as much as possible, since it is believed that light will reduce solution stability. The pH of the treatment solution of the present invention generally need not be modified, provided that the normal pH of the treatment solution (between about 4 and about 4.5, in the case of bis-(triethoxysilylpropyl) tetrasulfide) allows for complete hydrolysis. Of course the pH may be adjusted as needed in order to ensure complete hydrolysis, such as by the addition of acetic or formic acid.

Based upon the foregoing, it will be understood that the treatment solution of the present invention may simply comprise a solution of one or more hydrolyzed (at least partially), bis-functional polysulfur silanes (as described above), preferably in an alcohol/water solution. In fact, a preferred embodiment of the treatment solution of the present invention consists essentially of a solution of hydrolyzed bis-functional polysulfur silane(s).

The concentration of bis-functional polysulfur silanes in the treatment solution should be between about 0.1% and about 25% by volume, more preferably between about 1 and about 5%. Concentrations higher than these preferred ranges are not cost-effective, since no significant improvement in corrosion resistance will be provided, and may lead to solution instability. It should be noted that the concentration of silanes discussed and claimed herein are all measured in terms of the ratio between the volume of unhydrolyzed, bis-functional polysulfur silanes employed in the preparation of the treatment solution (i.e., prior to hydrolysis), and the total volume of treatment solution components (i.e., silanes, water, and alcohol). In addition, these concentrations refer to the total amount of unhydrolyzed bis-functional polysulfur silanes used in preparing the treatment solution, as multiple silanes may optionally be employed in this treatment solution.

Once the treatment solution has been prepared in the above-described manner, the metal substrate to be treated should be solvent and/or alkaline cleaned (by techniques well-known in the prior art) prior to application of the above-described treatment solution, rinsed in deionized water and then allowed to dry. The treatment solution may then be applied directly onto the cleaned metal (i.e., with no other layers between the metal and the treatment composition of the present invention) by either dipping the metal into the solution (also referred to as "rinsing"), spraying the solution onto the surface of the metal, or even wiping or brushing the treatment solution onto the metal substrate. When the preferred application method of dipping is employed, the duration of dipping is not critical, as it will generally not affect the resulting film thickness or performance. Nevertheless, it is preferred that the dipping time be between about 1 second and about 30 minutes, more preferably between about 5 seconds and about 2 minutes in order to ensure complete coating of the metal. Unlike other silane treatment methods, the thus-coated metal may be dried at room temperature, since no heating or curing of the silane coating is necessary. Typically, drying will take a couple of minutes at room temperature, depending in part upon how much water is provided in the treatment solution (as ratio of alcohol to water is decreased, drying time is increased). While multiple coatings may be applied, a single coating will normally be sufficient.

The above treatment method has been shown to provide unexpectedly superior corrosion prevention, particularly on zinc, copper, aluminum, and alloys of the foregoing metals. As used herein, the term "copper alloy" refers to any alloy wherein copper is the predominant metal (i.e., no other metal is present in an amount greater than copper). Zinc alloys and aluminum alloys are similarly defined. The treatment method of the present invention is particularly effective for preventing corrosion of brass (zinc-containing copper alloys) and bronze (copper alloys which typically include tin). Brass, for example, is highly susceptible to corrosion, particularly uniform corrosion in aqueous environments, dezincification (especially in acid-chloride containing solutions), and stress corrosion cracking (particularly in the presence of ammonia and amines). Heretofore, the only effective corrosion prevention techniques for brass of which Applicants are aware is painting, or adding an additional metal to the brass during alloying (such as in admiralty brass). However, painting is not always possible or desirable, such as when the brass is used in an artistic sculpture, and the addition of other alloying elements is expensive. Applicants have found, however, that the treatment method of the present invention is very effective in preventing corrosion of brass (and bronze) without the need for an outer layer of paint. Therefore, the methods of the present invention are particularly useful and effective in preventing the corrosion of brass and bronze sculptures.

The examples below demonstrate some of the superior and unexpected results obtained by employing the methods and treatment solution of the present invention. In all cases, the metal substrate samples were first alkaline cleaned using a standard, non-etching alkaline cleaner (AC1055, available from Brent America, Inc.). An 8% aqueous solution of the cleaner was heated to 70 to 80 deg. C, and the metal substrates were immersed in the hot solution for a period of 2–3 minutes. The substrates were then rinsed in de-ionized water until a water-break free surface was achieved. The rinsed samples were then blown dry with compressed air.

EXAMPLE 1

In order to compare the corrosion protection provided by the methods of the present invention with other treatment techniques, identical brass samples (alkaline cleaned, cold-rolled, 70/30 brass sheet) were coated with solutions of 1,2-bis-(triethoxysilyl) ethane ("BTSE"), vinyltrimethoxysilane, and bis-(triethoxysilylpropyl) amine, as well as a treatment solution according to the present invention.

The treatment solution according to the present invention was prepared as follows. 25 ml of water was thoroughly mixed with 450 ml of methanol (18 parts methanol for each part water, by volume). Next, 25 ml of bis (triethoxysilyipropyl) tetrasulfide was slowly added to the methanol/water mixture, while mixing, thereby providing a silane concentration of about 5%, by volume. The treatment solution was mixed for at least an hour in order to ensure sufficient hydrolysis of the silane. In order to prevent sulfur precipitation, the solution was then refrigerated such that the temperature was reduced to about 5 deg. C. Refrigeration also excluded light from the treatment solution. This treatment solution was then applied to a sample of cold-rolled, 70/30 brass sheet by dipping. The solution temperature was about 5 to 10 deg. C, and the sample was dipped for about 100 seconds. After coating, the sample was dried in air at room temperature.

Comparative treatment solutions of 1,2-bis-(triethoxysilyl) ethane ("BTSE"), vinyltrimethoxysilane, bis-(triethoxysilylpropyl) amine were prepared in a similar fashion. In all cases, the silane concentration was about 5%, and an alcohol/water solvent mix was used. In addition, the pH of each of each solution was adjusted, as needed, in order to ensure maximum hydrolysis. The pH of the BTSE and vinyltrimethoxysilane solutions was about 4 to about 6, while the pH of the bis-(triethoxysilylpropyl) amine solution was about 10 to about 11. Any needed adjustments to pH were accomplished using acetic acid and sodium hydroxide. Samples of alkaline-cleaned, cold-rolled, 70/30 brass sheet were coated with these solutions in the same manner described above.

In order to simulate the corrosive environment of seawater, the coated samples, and an uncoated control, were partially immersed in a 3% NaCl solution for 1000 hours. The samples were then removed and visually examined for any visible signs of corrosion, including attack at the water line and any discoloration. The results are provided in the table below.

| Sample | After 1000 hours in 3% NaCl solution |
|---|---|
| uncoated (only alkaline cleaned) | heavy discoloration, waterline attack with copper deposits present |
| BTSE | heavy discoloration, waterline attack with heavy copper deposits present |
| Vinyl Silane | slight discoloration, minimum deposit of copper at waterline |
| bis-(triethoxysilylpropyl) amine | blue copper deposits throughout the immersed region, heavy waterline attack |
| bis-(triethoxysilylpropyl) tetrasulfide | no change from original appearance |

EXAMPLE 2

Brass samples were prepared in accordance with the methods described in Example 1 above. The coated samples and uncoated control were then immersed in a 0.2N HCl solution for 5 days in order to examine the ability of the treatment solutions of the present invention to prevent dezincification. The following results were observed:

| Sample | After 5 days in 0.2 N HCl solution |
|---|---|
| uncoated (only alkaline cleaned) | dezincification observed throughout the immersed region |
| BTSE | heavy dezincification observed throughout the immersed region |
| Vinyl Silane | dezincification observed throughout the immersed region |
| bis-(triethoxysilylpropyl) tetrasulfide | no change from original appearance (i.e., no dezincification) |

EXAMPLE 3

Three brass samples were alkaline cleaned, and a treatment solution according to the present invention was prepared in accordance with the methods of Example 1. One of the brass samples was uncoated, and therefore acted as a control. The uncoated sample was bent over itself (180 degrees) in order to provide a high stress region on the sample for simulating stress corrosion cracking. The second sample was coated with the treatment solution of the present invention in the manner described in Example 1, and was then bent over itself. The third sample was first bent over itself, and was then coated with the treatment solution of the present invention in the manner described in Example 1. All three samples were then exposed to strong ammonia vapors for a period of 18 hours. After exposure, the samples were visually examined for corrosion, and thereafter opened (i.e., "unbent"). The results provided in the table below once again demonstrate the ability of the treatment method of the present invention to prevent corrosion, and also show that the coating thus provided is deformable:

| Sample | After 18-hour exposure to ammonia vapors | Effect of opening bend |
|---|---|---|
| uncoated control | heavy darkening of the entire surface | sample broke at the bend |
| coated, then bent | minimal darkening at edges | initiation of crack at one end of bend |
| bent, then coated | minimal darkening at edges | no crack initiated |

EXAMPLE 4

Three samples of Al 2024 were alkaline cleaned in the manner described previously. One sample acted as the control, and was not coated in any manner after alkaline cleaning. The second panel was subjected to a standard chromate treatment, in a manner well-known to those skilled in the art. The third panel was coated with the bis-(triethoxysilylpropyl) tetrasulfide solution described in Example 1, in the manner described therein.

In order to examine the formability of the coating as well as any negative effect of forming on corrosion performance, all three samples were deep drawn to a depth of about 8 mm in a cup drawing machine in order to make standard cups for use in Olsen testing. Since the drawing process necessitated the application of a lubricant to the inner surface of the cup, some solvent cleaning was performed (using methanol and hexane) after drawing in order to remove any oil contamination. The drawn samples were then completely immersed in a 3% NaCl solution for a period of one week, and the samples were then visually observed for signs of corrosion (both the inner and outer surfaces):

| Sample | After 1 week exposure to 3% NaCl solution |
|---|---|
| control (alkaline cleaned only) | discoloration of the entire surface, heavier at the drawn region; pitting with white deposits at many points on the sample; edge corrosion |
| chromated | slight discoloration of the sample, heavier at the drawn region; pitting heavy with white deposits throughout the sample |
| bis-(triethoxysilylpropyl) tetrasulfide | original appearance throughout the sample, including the drawn region; no pitting; no edge corrosion |

The above results demonstrate that the sulfur-containing silanes used in the methods and treatment solution of the present invention are also effective on aluminum and aluminum alloys.

EXAMPLE 5

In order to examine the effectiveness of the methods of the present invention in preventing corrosion of surfaces of zinc and zinc alloys (including, for example, hot-dipped galvanized steel), standard titanium zinc panels (primarily zinc, with less than 1% titanium; available from Nedzinc) were alkaline-cleaned in the manner described previously. One panel was uncoated, while another was coated with the treatment solution of Example 1, in the manner described therein. These panels were then subjected to the Butler Horizontal Water Immersion Test (developed by the Butler Manufacturing Company of Grandview, Mo.). The uncoated panel exhibited white rust over 80% of its surface after only one day, while the panel treated according to the present invention showed only 5% white rust after 6 weeks of exposure.

The foregoing description of preferred embodiments is by no means exhaustive of the variations in the present invention that are possible, and has been presented only for purposes of illustration and description. Obvious modifications and variations will be apparent to those skilled in the art in light of the teachings of the foregoing description without departing from the scope of this invention. Thus, it is intended that the scope of the present invention be defined by the claims appended hereto.

What we claim is:

1. A method of treating a metal surface to improve corrosion resistance, comprising the steps of:

(a) providing a metal surface; and (b) applying a treatment solution onto said metal surface, said treatment solution containing at least one bis-functional polysulfur silane which has been at least partially hydrolyzed, said silane comprising:

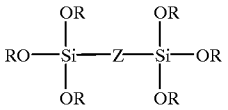

wherein each R is an alkyl or an acetyl group, and Z is either $—S_x$ or $—Q—S_x—Q—$, wherein each Q is an aliphatic or aromatic group, and x is an 10 integer of from 2 to 9.

2. The method of claim 1, wherein each R is individually chosen from the group consisting of: ethyl, methyl, propyl, iso-propyl, butyl, iso-butyl, sec-butyl, ter-butyl and acetyl.

3. The method of claim 2, wherein each Q is individually chosen from the group consisting of: $C_1$–$C_6$ alkyl (linear-or branched), $C_1$–$C_6$ alkenyl (linear or branched), $C_1$–$C_6$ alkyl substituted with one or more amino groups, $C_1$–$C_6$ alkenyl substituted with one or more amino groups, benzyl, and benzyl substituted with $C_1$–$C_6$ alkyl.

4. The method of claim 3, wherein said bis-functional polysulfur silane comprises a bis-(triethoxysilylpropyl) sulfide having 2 to 9 sulfur atoms.

5. The method of claim 4, wherein said bis-functional polysulfur silane comprises bis-(triethoxysilylpropyl) tetrasulfide.

6. The method of claim 1, wherein said metal is chosen from the group consisting of: zinc, zinc alloys, copper, copper alloys, aluminum, and aluminum alloys.

7. The method of claim 5, wherein said metal is chosen from the group consisting of: zinc, zinc alloys, copper, copper alloys, aluminum, and aluminum alloys.

8. The method of claim 1, wherein said metal comprises brass or bronze.

9. The method of claim 1, wherein x is 4.

10. The method of claim 1, wherein said treatment solution further comprises water and a solvent.

11. The method of claim 10, wherein said solvent comprises an alcohol chosen from the group consisting of: ethanol, methanol, propanol, and iso-propanol.

12. The method of claim 1, wherein the total concentration of said bis-functional polysulfur silanes in said treatment solution is between about 0.1% and about 25% by volume.

13. The method of claim 11, wherein the total concentration of said bis-functional polysulfur silanes in said treatment solution is between about 1 % and about 5% by volume.

14. The method of claim 13, wherein said alcohol is methanol, and said treatment solution has between about 3 and about 20 parts methanol per each part water.

15. The method of claim 14, wherein said metal is chosen from the group consisting of: zinc, zinc alloys, copper, copper alloys, aluminum, and aluminum alloys.

16. A metal surface having improved corrosion resistance, comprising:

(a) a metal surface, said metal chosen from the group consisting of: zinc, zinc alloys, copper, and copper alloys; and (b) a silane coating bonded to said metal surface, said silane comprising at least one bis-functional polysulfur silane which has been at least partially hydrolyzed, said bis-functional polysulfur silane comprising:

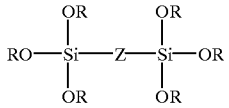

wherein each R is an alkyl or an acetyl group, and Z is either $—S_x$ or $—Q—S_x—Q—$, wherein each Q is an aliphatic or aromatic group, and x is an integer of from 2 to 9.

17. The metal surface of claim 16, wherein x is 4.

18. The metal surface of claim 16, wherein said metal is chosen from the group consisting of: copper, and copper alloys.

19. The metal surface of claim 18, wherein said metal comprises brass or bronze.

20. A method of treating a metal surface, comprising the steps of:

(a) providing a metal surface, said metal chosen from the group consisting of: zinc, zinc alloys, copper, and copper alloys;

(b) providing at least one bis-functional polysulfur silane, said silane comprising:

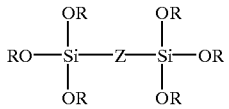

wherein each R is an alkyl or an acetyl group, and Z is either $—S_x$ or $—Q—S_x—Q—$, wherein each Q is an aliphatic or aromatic group, and x is an integer of from 2 to 9;

(c) at least partially hydrolyzing said at least one bis-functional polysulfur silane in order to form a treatment solution; and (d) applying said treatment solution onto said metal surface.

21. The method of claim 20, wherein each R is individually chosen from the group consisting of: ethyl, methyl, propyl, iso-propyl, butyl, iso-butyl, sec-butyl, ter-butyl and acetyl.

22. The method of claim 21, wherein each Q is individually chosen from the group consisting of: $C_1$–$C_6$ alkyl (linear or branched), $C_1$–$C_6$ alkenyl (linear or branched), $C_1$–$C_6$ alkyl substituted with one or more amino groups, $C_1$–$C_6$ alkenyl substituted with one or more amino groups, benzyl, and benzyl substituted with $C_1$–$C_6$ alkyl.

23. The method of claim 22, wherein said bis-functional polysulfur silane comprises a bis-(triethoxysilylpropyl) sulfide having 2 to 9 sulfur atoms.

24. The method of claim 23, wherein said bis-functional polysulfur silane comprises bis-(triethoxysilylpropyl) tetrasulfide.

25. The method of claim 20, wherein said metal is chosen from the group consisting of: copper, and copper alloys.

26. The method of claim 25, wherein said metal comprises brass or bronze.

27. The method of claim 20, wherein said treatment solution further comprises water and a solvent.

28. The method of claim 20, wherein the total concentration of said bis-functional polysulfur silanes in said treatment solution is between about 0.1 % and about 25% by volume.

29. The method of claim 27, wherein the total concentration of said bis-functional polysulfur silanes in said treatment solution is between about 1% and about 5% by volume.

* * * * *